US005870801A

United States Patent [19]

Kim

[11] Patent Number: 5,870,801

[45] Date of Patent: Feb. 16, 1999

[54] SCREWLESS MOUNTING FOR A DOOR HINGE PLATE OF A REFRIGERATOR

[75] Inventor: Yong-Myoung Kim, Suwon, Rep. of Korea

[73] Assignee: Samsung Electronics Co., Ltd., Suwon, Rep. of Korea

[21] Appl. No.: 898,405

[22] Filed: Jul. 22, 1997

[30] Foreign Application Priority Data

Oct. 8, 1996 [KR] Rep. of Korea ..... 96-44640

[51] Int. Cl.[6] ..... E05D 5/00; E05D 7/10

[52] U.S. Cl. ..... 16/382; 16/267; 16/270; 312/326; 312/405

[58] Field of Search ..... 16/382, 268, 267, 16/254, 258, 262, 263, 270, 243, DIG. 34; 312/326, 329, 296, 405, 401; 248/284.1; 49/381, 397, 388

[56] References Cited

U.S. PATENT DOCUMENTS 1,087,576 2/1914 Fernald ..... 16/259
3,510,986 5/1970 Berkowitz ..... 49/386
4,304,027 12/1981 Di Fazio ..... 16/382
5,159,740 11/1992 Brustle et al. ..... 16/382
5,193,308 3/1993 Davidian ..... 16/257
5,579,606 12/1996 Kim ..... 16/284
5,666,764 9/1997 Beatty et al. ..... 16/254

*Primary Examiner*—Chuck Y. Mah
*Attorney, Agent, or Firm*—Burns, Doane, Swecker & Mathis, L.L.P.

[57] ABSTRACT

A refrigerator has a door-coupling structure facilitating the connection or disconnection of a door relative to a main body. The main body forms a food storage chamber which is opened and closed by the door. The door is hingedly mounted to the body by a hinge plate. An auxiliary hinge plate is fixed to the main body, and the rear end of the hinge plate is placed on the auxiliary plate. A fixing plate is disposed on the hinge plate and detachably coupled with the auxiliary hinge plate by a snap-on connection so as to secure the hinge plate onto the auxiliary hinge plate in the absence of separate fasteners such as bolts or screws.

10 Claims, 4 Drawing Sheets

SCREWLESS MOUNTING FOR A DOOR HINGE PLATE OF A REFRIGERATOR

BACKGROUND OF THE INVENTION (1) Field of the Invention

The present invention generally relates to a refrigerator. More particularly, it relates to a refrigerator having an improved hinge assembly for a door that opens and closes the food storage chamber of the refrigerator.

(2) Description of the Prior Art

In a conventional refrigerator, air cooled by an evaporator during the refrigerating cycle, is furnished to the freezing and refrigerating compartments of the refrigerator so as to keep various foods fresh longer and retard decay.

Recently, large-capacity refrigerators have gained popularity. These refrigerators' food storage chambers are divided into right and left compartments by a partition within a main case that forms an external main body. Doors to each compartment are hinged respectively on the right and left of the front of the main body by upper and lower hinge members. The upper hinge members that are bolted to the top of the main body respectively make axial connections with the doors' upper ends. The lower hinge members that are joined to the bottom of the main body are respectively connected with the lower ends of the doors.

As shown in FIG. 4, an upper hinge member 3 is formed of the combination of a hinge plate 3*a* and a downward hinge shaft 3*b* provided to a front end of the hinge plate 3*a*. The hinge plate 3*a* is fastened to the top of the main body 1 with bolts 3*c*. A door coupling hole 2*a* is formed on the top of the door 2 in a place that corresponds to location of the hinge shaft 3*b*. The hinge shaft 3*b* of the hinge plate 3*a* is inserted into the door coupling hole 2*a*, the bottom of the door 2 is connected with the lower hinge member (not illustrated) in a similar manner. This arrangement allows the door to open and close the food storage chamber (not illustrated) by rotating about the hinge shaft 3*b*.

Often, this large-capacity refrigerator is too big to pass through the front door of an apartment, so carriers have to disconnect the door 2 from the refrigerator and carry the main body 1 and the door 2 separately, and rejoin the door 2 to the main body 1 after it has been brought into the apartment. Unfortunately, it takes time to unfasten and fasten each of the bolts 3*c* when disconnecting and rejoining the door 2, and the repetition of their procedure can cause the bolts 3*c*' screw thread to be worn away, making them unusable. Lastly, the extra tools needed to fasten and unfasten the bolts 3*c* further complicates the removal and reattachment process.

SUMMARY OF THE INVENTION

It is the objective of the present invention to provide a refrigerator whose hinge plate, which supports a door to allow it to swing about the hinge plate, is detachably joined to the main body by coupling means other than bolts, thus facilitating the connection or disconnection of the door to or from the main body.

In order to obtain the aforementioned objective, the inventive refrigerator which includes a main body, a food storage chamber inside the main body, a door for opening or closing the food storage chamber, and a hinge plate upon which the door rotates, further comprises an auxiliary hinge plate secured to the main body, on which the rear end of the hinge plate is placed; and a fixing plate detachably coupled with the auxiliary hinge plate so as to securely fix the hinge plate onto the auxiliary hinge plate.

The auxiliary hinge plate includes a pair of rotation supporters formed on one end and each having a notch, a vertically extending part formed on the other end, and at least one projection provided on the middle of the auxiliary hinge plate. The fixing plate includes a locking member formed on one end, a rotating pin passing through the locking member, and a catch formed on the other end. The rotating pin is inserted into the notches of the rotating supporters and the catch mates with the vertically extending part, thus detachably connecting the fixing plate with the auxiliary hinge plate.

DETAILED DESCRIPTION OF THE PREFERRED EMBODIMENT

The preferred embodiment of the present invention will now be described in detail with reference to the accompanying drawings.

Figure 1:
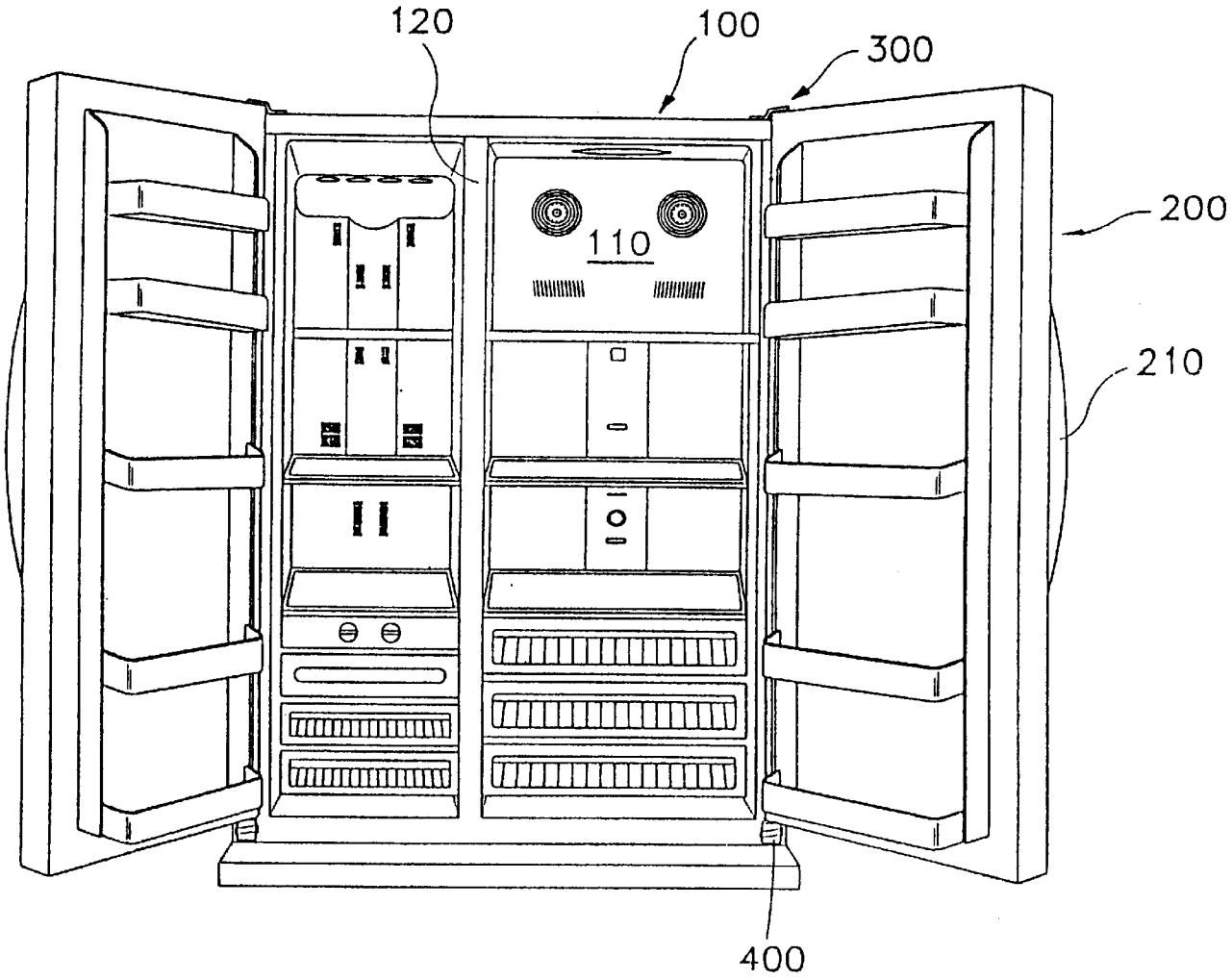
FIG. 1 is a schematic view of the overall construction of a refrigerator in accordance with the present invention.

FIG. 1 is a schematic view of the overall construction of a refrigerator in accordance with the present invention.

Figure 2:
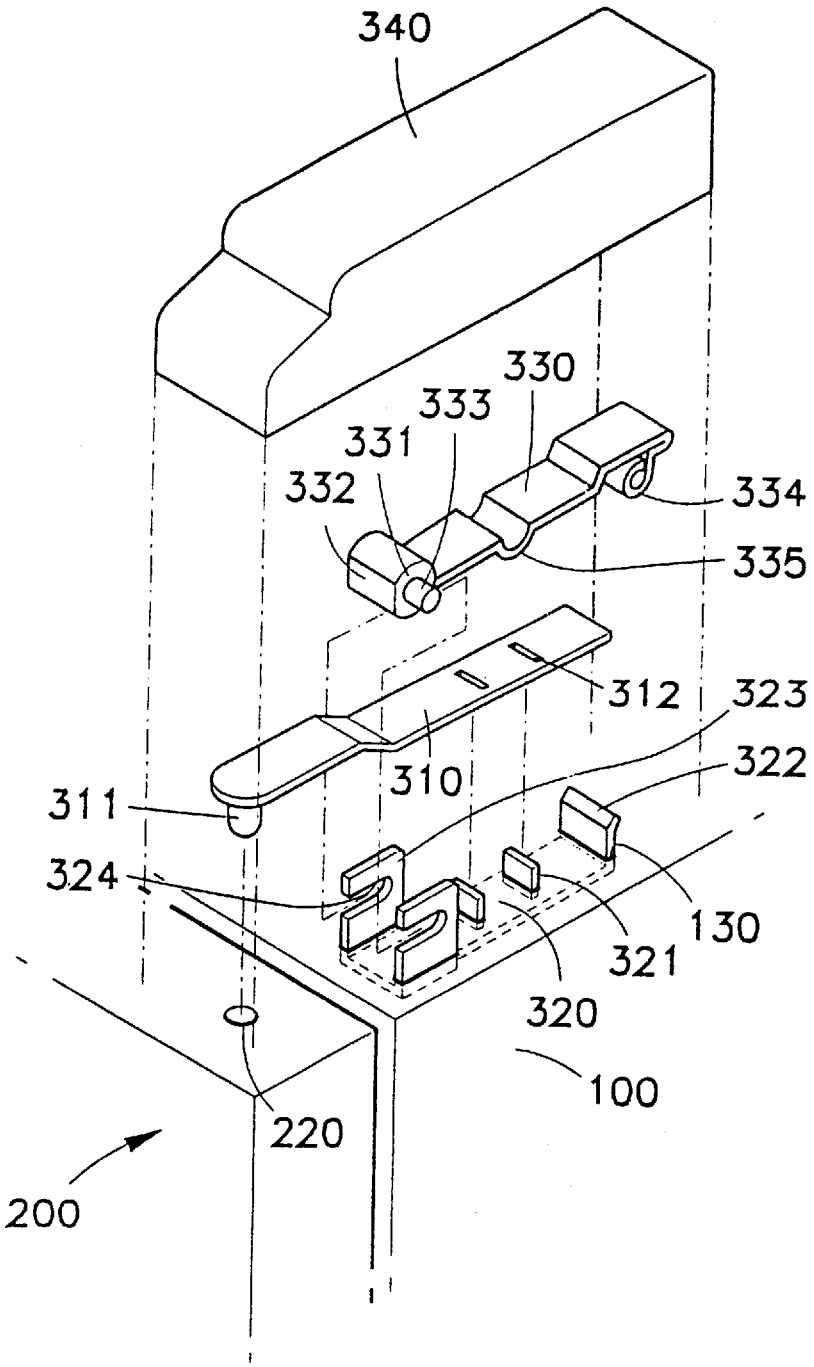
FIG. 2 is an exploded-perspective view of a door and a hinge assembly of a refrigerator in accordance with the present invention.
Figure 3:
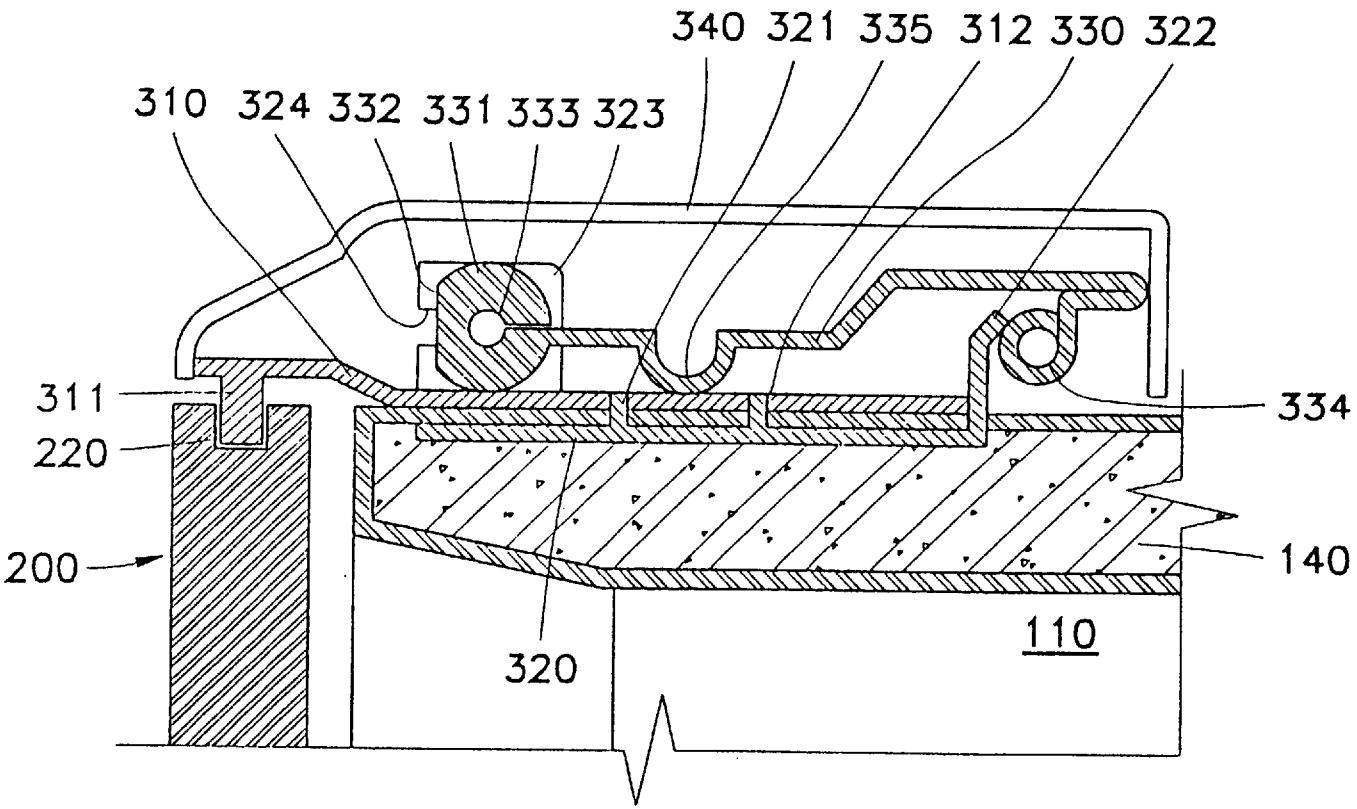
FIG. 3 is a sectional view of the coupling structure of a hinge plate in accordance with the present invention.
Figure 4:
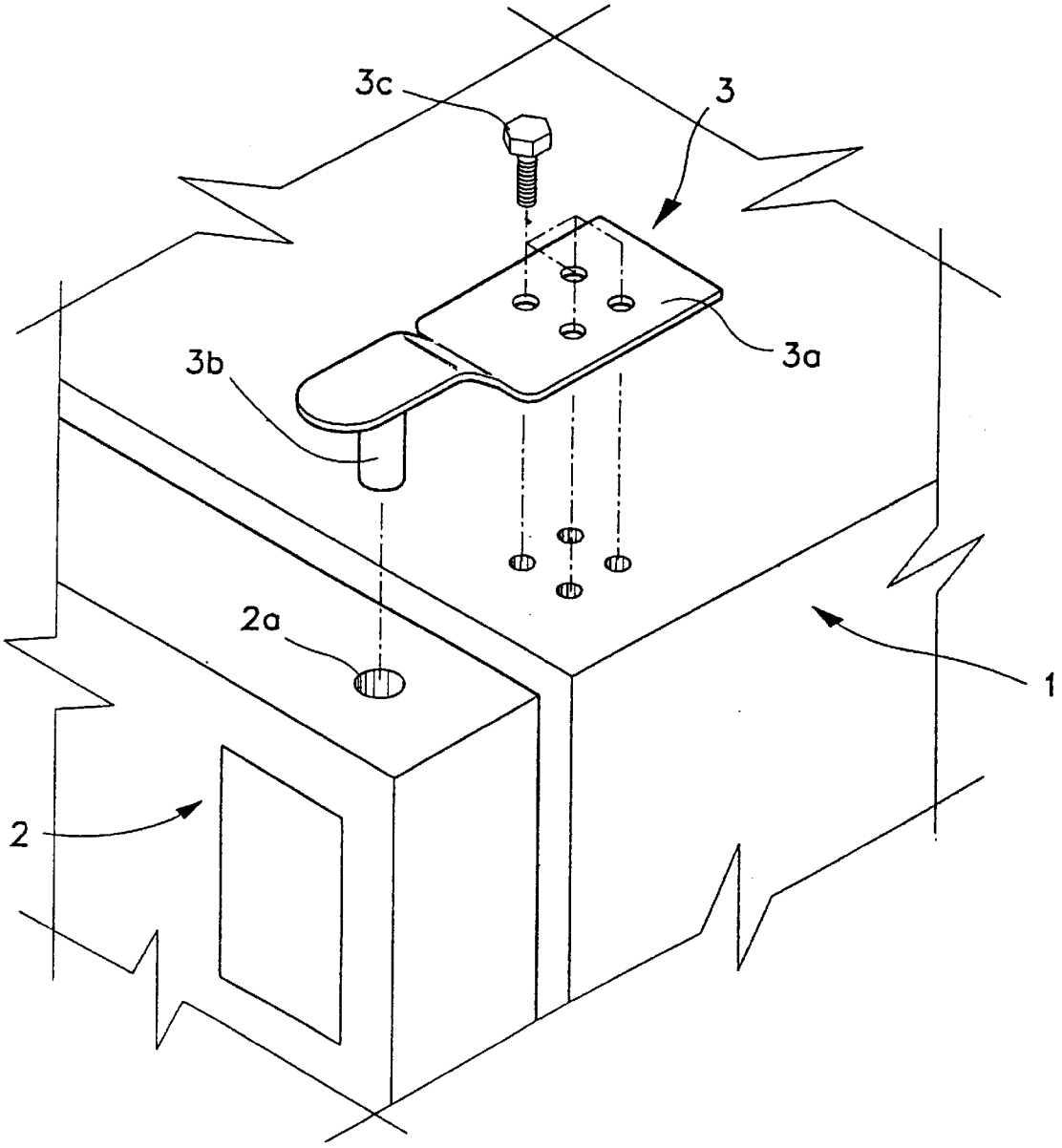
FIG. 4 (PRIOR ART)
FIG. 4 is an exploded-perspective view of a conventional door and upper hinge member of a refrigerator.

FIG. 2 is an exploded-perspective view of a door and a hinge assembly of a refrigerator in accordance with the present invention, and FIG. 3 is a sectional view of a hinge plate in accordance with the present invention.

A large-capacity refrigerator includes a main body 100, a food storage chamber 110 divided into two compartments by a partition 120 within the main body 100, doors 200 each having a handle 210 and hinged at the front sides of the main body 100 to open and close the food storage chamber 110. Upper and lower hinge members 300 and 400 support these doors 200 respectively at their upper and lower parts to allow the doors 200 to swing about the hinge members 300 and 400. The upper hinge member 300, the characteristic feature of the present invention, will be fully described referring to FIGS. 2 and 3.

The upper hinge member 300 is realized as a hinge plate 310 with a hinge shaft 311 that is connected with the door 200, an auxiliary hinge plate 320 that is fixed to the main body 100 and detachably connects to the hinge plate 310, and a fixing plate 330 that is detachably coupled to the auxiliary hinge plate 320 so as to securely connect the hinge plate 310 to the auxiliary hinge plate 320.

A first end of the auxiliary hinge plate 320 has a first connection part in the form of rotation supporters 323 formed on the end facing the door 200, a second connection part in the form of a vertically extending part 322, formed on the other end, that stands upright but has its tip bent away from the door, and a pair of projections 321 positioned in the middle that extend upward. The rotation supporters 323 each have a slot or notch 324 into which one end of the fixing plate 330 is inserted for fastening.

This auxiliary hinge plate 320 is installed within the main body 100, and the main body 100 has insertion holes 130 respectively corresponding to the rotation supporters 323, the projections 321, and the vertically extending part 322 so that the latter three can protrude to the outside therethrough. Urethane 140, an insulator, is provided to the inside of the main body 100 over the auxiliary hinge plate 320, so the auxiliary hinge plate 320 is securely attached to the main body 100 without any extra fixing means.

The hinge shaft 311, formed on one end of the hinge plate 310, protrudes downward so it can be inserted into a door coupling hole 220 that is provided to the top of the door 200 for axial connection. Additionally, slots 312 that respectively correspond to the projections 321 of the auxiliary hinge plate 320 are provided in the middle of the hinge plate 310. The projections 321 fit into the slots 312 so the hinge plate 310 lies on the top of the main body 100.

On one end of the fixing plate 330 is a cylindrical locking member 331 and a third connection part in the form of a rotating pin 333 that passes through the locking member 331. A fourth connection part in the form of a cylindrical catch 334 is formed on the other end of the fixing plate 330 to mate with the vertically extending part 322 of the auxiliary hinge plate 320, providing the detachable connection of the fixing plate 330 with the auxiliary hinge plate 320. The area of the cylindrical locking member 331 that faces away from the refrigerator is a flat portion 332. It is designed to not contact the hinge plate 310 during the joining and disjoining of the locking member and the auxiliary hinge plate 320, wherein the fixing plate 330 is inserted into or is removed from the notches 324 of the rotation supporters 323.

When the fixing plate 330 is coupled with the auxiliary hinge plate 320, a semicircular compressing part 335, formed under the middle of the fixing plate 330, presses the hinge plate 310 against the main body 100 for fastening. A cover 340, used to provide protection to the hinge assembly against an outside shock and for aesthetic purposes, is connected with one end of the hinge plate 310 and one end of the fixing plate 330.

The following description relates to the connection of the door 200 to the main body 100 by the use of the upper hinge member 300.

The lower end portion of the door 200 is first joined to the lower hinge member 400 on the bottom of the main body 100. Next, the projections 321 fit into the slots 312 as the hinge shaft 311 of the upper hinge member 300 is inserted into the door coupling hole 220, thus connecting the upper hinge member 300 with the main body 100. Then, the fixing plate 330 is installed, wherein the cylindrical catch 334 mates with the vertically extending part 322 after the rotating pin 333 of the fixing plate 330 has been inserted into the notches 324 to form a pin-and-slot connection. This securely joins the fixing plate 330 with the auxiliary hinge plate 320. Also the hinge plate 310 is more firmly secured to the main body 100 by the compressing part 335 of the fixing plate 330. In addition, a space is created between the locking member 331 and the hinge plate 310 when the flat portion 332 of the cylindrical locking member 331 is rotated downward when inserting the rotating pin 333 into the notches 324, thereby making it easier to fit the rotating pin 333 into the notches 324.

The cover 340 joined to one end of the hinge plate 310 and one end of the fixing plate 330, seals the upper hinge member 300, thereby completing the connection of the door 200 to the main body.

The disconnection of the door 200 is performed in reverse order.

The cover 340, connected with one end of the hinge plate 310 and one end of the fixing plate 330, is removed first. Then, the cylindrical catch 334 is removed from the vertically extending part 322 in response to the application of an upward force to the respective end of the fixing plate. At this point, the fixing plate 330 is moved downward, thereby facilitating the separation of the rotating pin 333 from the notches 324, thus removing the fixing plate 330 from the main body 100. The hinge plate 310, positioned on the top of the main body 100, is disjoined from the main body 100, and the lower portion of the door 200 is then lifted away from the lower hinge member 400, completing the disconnection of the door 200 from the main body 100.

As described above, the refrigerator of the present invention utilizes a hinge assembly which connects its hinge plate to the main body of the refrigerator without any bolts, thereby providing for the door to be securely connected to and easily disconnected from the main body while obviating the need for additional tools and expediting the door installation and removal processes.

What is claimed is:

1. A refrigerator including a main body, a food storage chamber inside said main body, a door for opening and closing said food storage chamber, and a hinge plate with one end supporting said door to swing about a hinge axis and the other end connected with said main body, said refrigerator further comprising:

an auxiliary hinge plate secured to said main body, on which the rear end of said hinge plate is placed; and a fixing plate detachably coupled with said auxiliary hinge plate so as to closely fix said hinge plate onto said auxiliary hinge plate;

wherein said auxiliary hinge plate includes a pair of rotation supporters formed on one end and including a notch, a vertically extending part formed on the other end, and at least one projection provided on the middle of said auxiliary hinge plate, and said fixing plate includes a locking member formed on one end and a pin passing through said locking member, and a catch formed on the other end, and said pin is inserted into each notch of said rotating supporters for rotation therein, and said catch mates with said vertically extending part, thus detachably connecting said fixing plate with said auxiliary hinge plate.

2. A refrigerator as set forth in claim 1, wherein said hinge plate has at least one slot corresponding to the at least one projection of said auxiliary hinge plate.

3. A refrigerator as set forth in claim 1, wherein said locking member is of cylindrical shape, and is integrally formed on one end of said fixing plate.

4. A refrigerator as set forth in claim 3, wherein said locking member has a flat portion on one side.

5. A refrigerator as set forth in claim 1, wherein said catch has a hollow interior, is of cylindrical shape, and is integrally formed on the other end of said fixing plate.

6. A refrigerator as set forth in claim 1, wherein said vertically extending part is formed to stand upright on the other end of said auxiliary hinge plate and has a tip which is bent toward the back of the refrigerating so as to hold or release said catch.

7. A refrigerator as set forth in claim 1, wherein said fixing plate has a compressing part of semicircular shape formed in its middle to push said hinge plate against the main body, thereby closely fixing said hinge plate to said main body.

8. A refrigerator comprising:

a main body forming a food storage chamber therein, a door hingedly connected to said body for opening/closing said chamber;

an auxiliary hinge plate secured to said body and including first and second ends forming first and second connection parts, respectively;

a hinge plate having first and second portions, said first portion mounted to said door to form a vertical hinge axis therewith; said second portion engaging said auxiliary hinge plate;

a fixing plate including first and second ends forming third and fourth connection parts, respectively, said third and fourth connection parts being releasably connected to said first and second connection parts, respectively, of said auxiliary hinge plate, in the absence of separate fasteners, to secure said second portion of said hinge plate between said auxiliary hinge plate and said fixing plate.

9. The refrigerator according to claim 8 wherein said first and third connection parts together form a pivot connection enabling said fixing plate to rotate relative to both said auxiliary plate and said hinge plate, said second and fourth connection parts together forming a connection releasable in response to the application of a force to said second end of said fixing plate.

10. The refrigerator according to claim 9 wherein said first and third connection parts form a pin-and-slot connection enabling said first end of said fixing plate to be removed from said auxiliary hinge plate by sliding a pin on one of said first and third connection parts relative to a slot on the other of said first and third connection parts when the second and fourth connection parts are released from one another.

* * * * *